US005895340A

United States Patent [19]

Keller

[11] Patent Number: 5,895,340

[45] Date of Patent: Apr. 20, 1999

[54] TRAINING DEVICE ESPECIALLY ADAPTED FOR USE IN TEACHING TECHNIQUES FOR SNOW BOARDING, SKIING AND THE LIKE

[76] Inventor: Martin Keller, 13880 Wide Acres Rd., Golden, Colo. 80401

[21] Appl. No.: 08/856,377

[22] Filed: May 14, 1997

[51] Int. Cl.[6] ..... A63B 22/00; A63B 69/18

[52] U.S. Cl. ..... 482/71; 482/51; 434/253

[58] Field of Search ..... 482/71, 51, 114, 482/115, 118, 66, 70; 434/253; 601/33, 34, 35

[56] References Cited

U.S. PATENT DOCUMENTS

| | | | |
|---|---|---|---|
| 3,107,914 | 10/1963 | Swisher . | |
| 3,408,067 | 10/1968 | Armstrong . | |
| 3,511,499 | 5/1970 | Schawalder . | |
| 3,531,110 | 9/1970 | Marchu | 482/71 |
| 3,575,412 | 4/1971 | Arsenian . | |
| 3,791,645 | 2/1974 | Stelma | 482/71 |
| 3,807,727 | 4/1974 | Ferguson . | |
| 4,183,521 | 1/1980 | Kroeker . | |
| 4,252,312 | 2/1981 | Dehan . | |
| 4,290,601 | 9/1981 | Mittelstadt . | |
| 4,342,453 | 8/1982 | Wagner | 482/71 |
| 4,386,915 | 6/1983 | Gilliam . | |
| 4,505,477 | 3/1985 | Wilkinson . | |
| 4,621,620 | 11/1986 | Anderson | 601/34 |
| 4,669,723 | 6/1987 | Arsenian . | |
| 4,708,339 | 11/1987 | Perrine . | |
| 4,787,630 | 11/1988 | Watson . | |
| 4,834,073 | 5/1989 | Bledsoe | 601/34 |
| 4,869,496 | 9/1989 | Colombo | 482/71 |
| 4,911,430 | 3/1990 | Flament . | |
| 4,953,853 | 9/1990 | Loane | 482/71 |
| 5,192,258 | 3/1993 | Keller | 482/71 |
| 5,328,427 | 7/1994 | Sleamaker | 482/71 |
| 5,374,228 | 12/1994 | Buisman | 482/51 X |
| 5,490,818 | 2/1996 | Haber . | |
| 5,496,239 | 3/1996 | Kallman | 482/51 X |
| 5,503,609 | 4/1996 | Bull | 482/70 |
| 5,545,115 | 8/1996 | Corcoran . | |

FOREIGN PATENT DOCUMENTS

| | | |
|---|---|---|
| 204939 | 1/1959 | Austria . |
| 832295 | 9/1938 | France . |
| 886917 | 12/1981 | U.S.S.R. . |

OTHER PUBLICATIONS

Nordic Sport, Brochure, 1992.

Ski Magazine, Oct. 1990 advertisement for Skier's Edge ski training device.

*Primary Examiner*—Richard J. Apley

*Assistant Examiner*—William LaMarca

[57] ABSTRACT

A training device for use in teaching techniques for snow boarding, skiing, and the like, includes a carriage including two spaced vertical posts. A tubular arcuate track extends between the posts and forms a segment of a circle lying in an inclined plane. An elongated support member formed, for example, in the shape of a snow board or skis, is secured adjacent a first, lower end to the carriage by a ball and socket mechanism. A guide roller assembly mounted for pivotal movement on the bottom surface of the support member allows a user to move the support member along the arcuate track and to incline the support member from side to side, simulating the edging techniques used in the actual turning of skis or a snow board. A plurality of rollers mount the carriage for translational movement along a linear guide path. An electric or hydraulic system connected to a cable and pulley drive mechanism translationally moves the carriage along the guide path in response to detection of edging or inclination of the support member by a sensor, simulating the actual movement of skis or a snow board across a slope in response to left or right edging.

15 Claims, 5 Drawing Sheets

TRAINING DEVICE ESPECIALLY ADAPTED FOR USE IN TEACHING TECHNIQUES FOR SNOW BOARDING, SKIING AND THE LIKE

CROSS-REFERENCE TO RELATED APPLICATIONS

This application is directed to an improvement of the invention disclosed and claimed in Applicant's prior U.S. patent application Ser. No. 603,651, filed Oct. 26, 1990, entitled "Training Device Especially Adapted For Teaching Snow Boarding Techniques" and issued as U.S. Pat. No. 5,192,258 on Mar. 9, 1993. The entire disclosure of the above-captioned patent is hereby incorporated by reference herein.

BACKGROUND OF THE INVENTION

1. Field of the Invention

The present invention relates to training devices, and more particularly pertains to a training device for use in teaching techniques for snow boarding, skiing, and other similar sports such as in line skating, skate boarding, surfing, water skiing, wind surfing, bicycling, and the like.

2. Description of the Prior Art

When an individual snow boards or skis down a slope, the individual inclines or edges the skis or snow board in order to traverse the slope from side to side while descending in elevation. The energy necessary to produce inertia and other forces, chiefly centripetal force, generated while traversing a slope when skiing or snow boarding is furnished by gravity, or more specifically the reduction of potential gravitational energy resulting from the individual moving from a higher elevation to a lower elevation. Accordingly, a significant portion of the energy required by an individual to effect a turn is provided from an external source, gravity, rather than from the muscles of the user. In the case of water skiing, a large part of the forces are generated by the tow boat.

A variety of training devices intended for use in teaching techniques for skiing and other sports exist in the prior art. Such prior art devices typically require a user to generate all forces required for operation and movement of the components of the training device from the muscles of the user, and thus do not accurately simulate the turning techniques associated with actual sporting activities such as snow boarding, skiing, etc. Representative examples of such prior art training devices include Applicant's prior U.S. Pat. No. 5,192,258, and the references cited therein.

Certain types of prior art training devices exist which do provide an external energy source. One type of device in this category provides an inclined endless loop belt upon which an individual wearing skis stands, and moves from side to side on the belt by edging the skis.

Another type of known training device mounts a pair of simulated skis on a wheeled carriage for side-to-side movement along a track, propelled by forces generated by the user's muscles. Some such devices include a spring or elastic member for storing energy produced by the user's muscles to provide a centering or restorative force to the carriage after the carriage reaches a laterally outer position at either side of the track.

Applicant recalls seeing another prior art ski training device many years ago, invented by Ray Hall, which device included roller skate-type wheels mounted on bottom surfaces of a pair of skis supported on a transverse rotating cylinder, such that edging of the skis by a user effected limited side-to-side translational movement of the skis along the length of the rotating cylinder. Applicant believes that Mr. Hall's device used an electric motor to drive the rotating cylinder. Applicant has heard that Mr. Hall obtained a U.S. patent for the device many years ago, but has been unable to locate or specifically identify the patent.

However, Applicant is not aware of any training devices for snow boarding, skiing, or the like, which employ an external energy source in conjunction with a sensor to detect inclination or edging of a support member to automatically translationally move the support member in response to edging by a user.

SUMMARY OF THE INVENTION

The Applicant's invention comprises an improvement for any sport training device, simulates the effect of the inertial forces of centripetal, centrifugal, acceleration and deceleration.

A training device for use in teaching techniques for snow boarding, skiing, and the like, includes a carriage including two spaced vertical posts. A tubular arcuate track extends between the posts and forms a segment of a circle lying in an inclined plane. An elongated support member formed, for example, in the shape of a snow board or skis, is secured adjacent a first, lower end to the carriage by a ball and socket mechanism. A guide roller assembly mounted for pivotal movement on the bottom surface of the support member allows a user to move the support member along the arcuate track and to incline the support member from side to side, simulating the edging techniques used in the actual turning of skis or a snow board. A plurality of rollers mount the carriage for translational movement along a linear guide path. An electrical, mechanical, or hydraulic system connected to a cable and pulley drive mechanism translationally moves the carriage along the guide path in response to detection of edging or inclination of the support member by a sensor, simulating the actual movement of skis or a snow board across a slope in response to left or right edging.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 1:
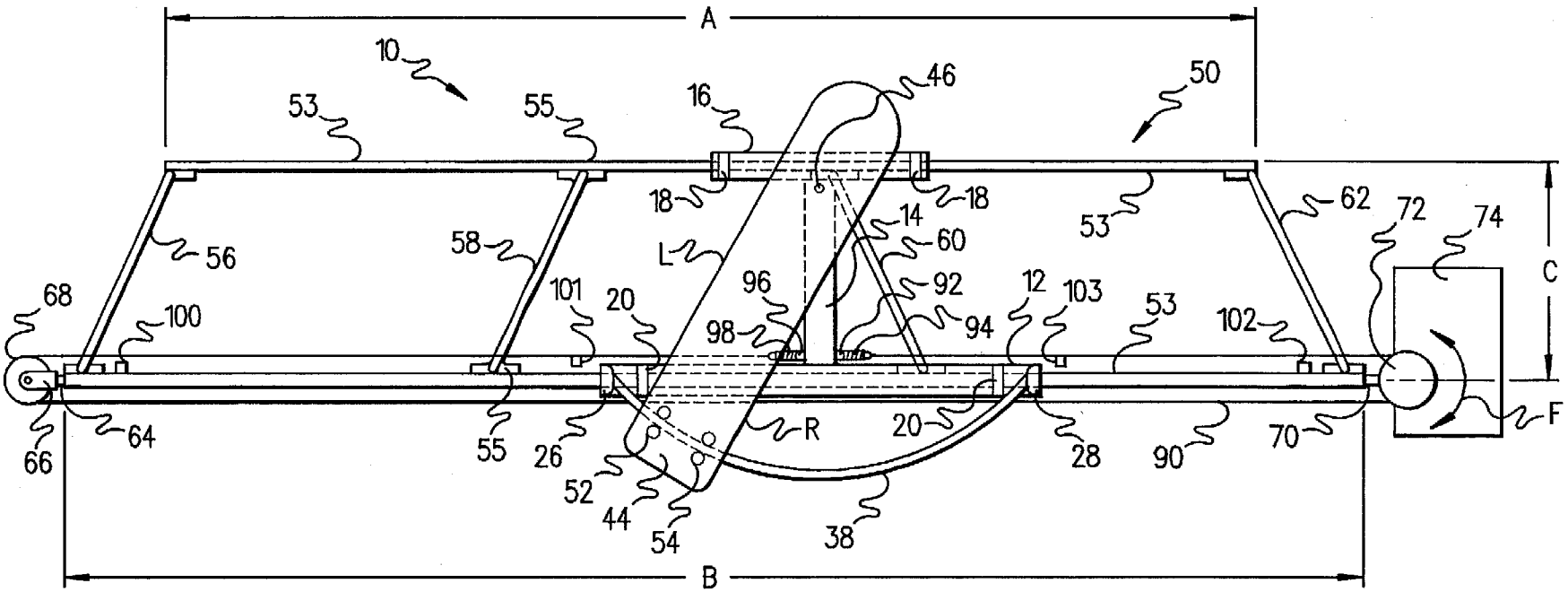
FIG. 1 is a top plan view of the training device according to an embodiment of the present invention.

Referring now to the drawings, wherein like reference numerals designate corresponding structure throughout the views, and referring in particular to FIGS. 1 and 2, an improved training device 10 for use in teaching techniques for snow boarding, skiing, and other similar sports such as in line skating, skate boarding, surfing, water skiing, wind surfing, and the like, will now be described.

A training device 10 according to an example illustrative embodiment of the present invention includes a carriage assembly comprising a rear rail member 12 connected to a front rail member 16 by a cross rail member 14. The rail members 12 and 16 may take the form of elongated rectangular channels formed from aluminum, other metal, plastics, composites, etc. Rollers 18 and 20 mounted within the rail members 16 and 12, respectively, mount the carriage assembly for reciprocal translational movement along a linear path in a manner detailed hereinafter.

A pair of vertical posts 26 and 28 perpendicularly secured adjacent opposite ends of the rear rail member 12 mount support an arcuate track 38, as described more fully in Applicant's prior U.S. Pat. No. 5,192,258. In connection with the illustrated example embodiment, the training device 10 takes the form of a snow board training device, and includes a support member 44 configured in the shape of a snow board. A ball and socket connection 46 pivotally mounts a front portion of the support member 44 to a front end of the cross rail member 14.

With reference to FIGS. 1–4, a hinge assembly 49 including a hinge pin 51 connect a tilt plate 45 to a roller mounting plate 47 to provide for selective reciprocal limited pivotal movement of the tilt plate 45 about the longitudinal axis of the hinge pin 51 relative to the roller mounting plate 47, as indicated by arrows G and H. Conventional fasteners (not shown) such as screws, bolts, adhesives, etc., secure the tilt plate 45 to the bottom surface of the support member 44, such that the support member 44 also pivots relative to the roller mounting plate 47. An elastomeric pad 48 disposed between the tilt plate 45 and the roller mounting plate 47 controls the amount of force which must be applied to pivot the tilt plate 45, and also provides a restorative force which biases the tilt plate 45 to a level orientation. Roller assemblies 52 and 54 secured to the bottom surface of the mounting plate 47 mount the support member for reciprocal movement along the track 38 in a manner more fully described in U.S. Pat. No. 5,192,258.

In use an individual standing on the upper surface of the support member 44 selectively positions their weight to the left L or right R edges of the support member 44, causing limited inclination in the directions G and H, respectively. In accordance with the present invention, a sensor, diagrammatically illustrated at 50, is provided for the purpose of detecting inclination of the tilt plate 45. The sensor 50 may take a variety of different forms, and need not necessarily be physically mounted on the hinge assembly 49 as illustrated, but may for example comprise a pair of switches or other type sensors 50' and 50" mounted on lateral surfaces of the elastomeric pad 48. The sensor 50 may comprise a potentiometer which produced a variable resistance dependent upon the relative rotary positions of the hinge assembly 49 and the hinge pin 51. Alternatively, the sensor 50 may comprise one or more limit switches disposed between the plates 45 and 47. The sensor may take the form of a pneumatic or hydraulic valve actuated by inclination of the plate 45. Hydraulic, pneumatic, resistance, capacitance, infra-red, radio frequency, inductive, piezo electric, and other types of sensors may be employed.

Figure 2:
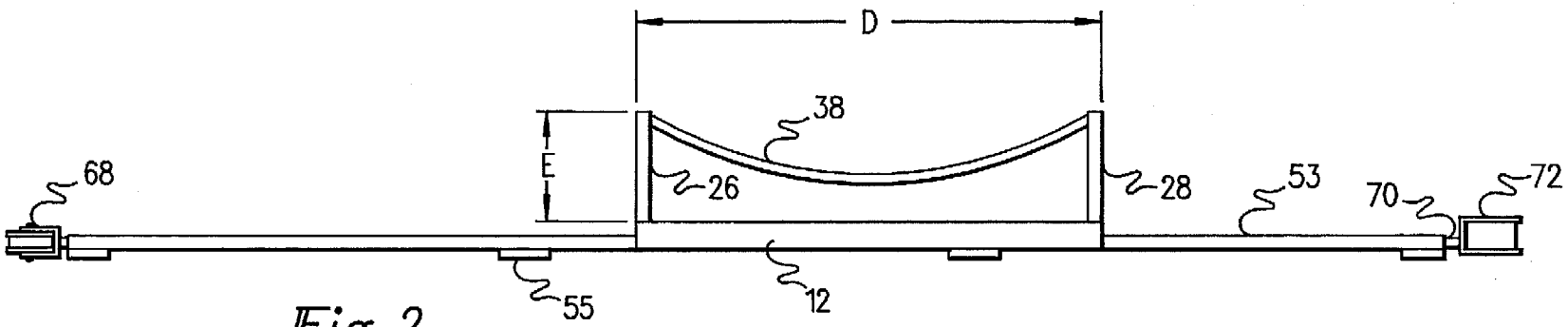
FIG. 2 is a rear elevational view of the carriage and guide path components of the training device according to an embodiment of the present invention.

The purpose of the aforementioned sensor 50 is to provide a control input signal for controlling lateral reciprocation of the carriage assembly 11 along a linear track 50, shown in FIG. 1. The linear track 50 may include a plurality of elongated cylindrical linear guide members 53 detachably connected by a plurality of telescopic pin and socket type connectors 55 and cross braces 56, 58, 60, and 62. This construction allows convenient disassembly of the training device 10 for transportation or storage. In operation, the rollers 18 and 20 ride on the guide members 53, as shown in FIG. 1. With reference to FIGS. 1 and 2, an example preferred embodiment of the invention may have the following dimension: A: 10 feet; B: 12 feet; C: 2 feet; D: 4 feet; and E: 1 foot.

Figure 4:
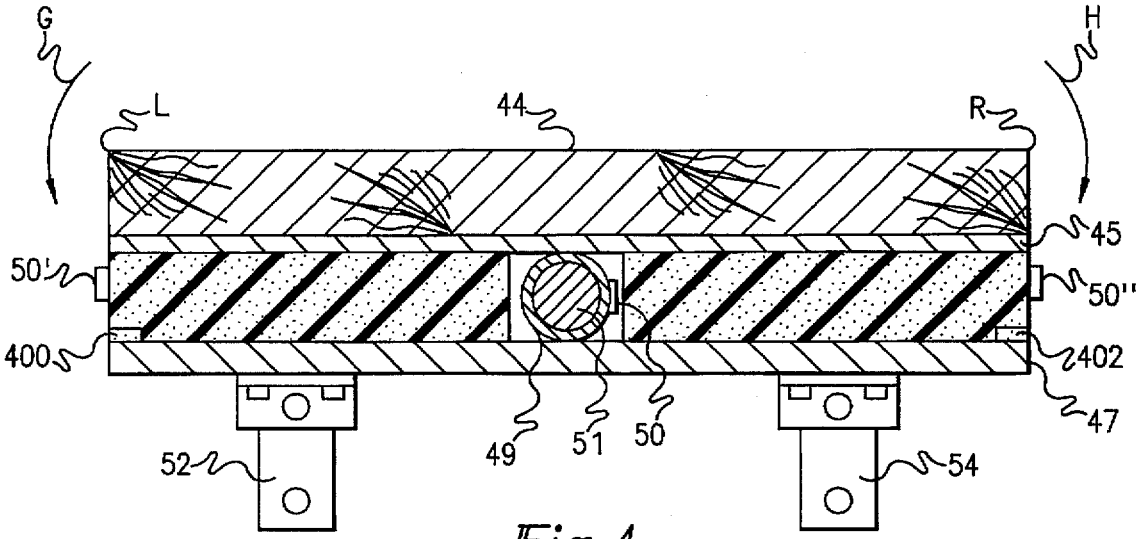
FIG. 4 is a transverse cross-sectional view of the support member of the training device according to an embodiment of the present invention, illustrating a tilt plate mechanism for permitting a user to simulate edging techniques by selectively inclining the support member from side to side.

In order to provide motive power to effect selective translational linear movement of the carriage assembly 11 along the linear track 50, the present invention provides a drive system for imparting controlled movement to the carriage assembly 11, dependent upon the inclined position of the tilt plate and support member 44 shown in FIG. 4. Thus, when an individual causes the support member 44 to incline in the direction G shown in FIG. 4, the carriage assembly 11 moves to the left in FIG. 1. Similarly, when an individual inclines the support member 44 in the direction H shown in FIG. 4, the carriage assembly moves to the right in FIG. 1. with reference to FIGS. 1 and 2, in order to effect such controlled linear movement of the carriage assembly 11, the illustrated embodiment of the training device 10 provides a cable and pulley drive mechanism including a pulley 68 mounted by a sheave 66 and stub shaft 64 to a left rear portion of the linear track 50. A similar stub shaft 70 mounts a drive pulley 72 to a right rear portion of the linear track 50. A cable 90 disposed around the pulleys 68 and 72 has opposite ends secured to tabs 92 and 96 disposed on opposite sides of the cross rail 14 of the carriage assembly 11. A pair of coil springs 94 and 98 disposed between the cable ends and the tab 92 and 96 provide a shock mounting to dampen shock transmitted to the carriage assembly 11 upon a change of direction. A drive motor assembly 74 connected in drive relationship to the drive pulley 72 operates to selectively rotate the pulley 72 in a selectively reversible rotary direction, as indicated by arrow F in FIG. 1. Toward this end, the cable 90 may make several wraps around the drive pulley 72 to prevent slippage of the cable 90 relative to the drive pulley 72. The drive motor assembly 74 may take a variety of forms, such as various types of reversible electric motors, non-reversible motors and a reversible transmission system, rotary hydraulic motors, etc. Other types of drive systems in place of the illustrated cable and pulley system may also be employed. For example, a rack and pinion type drive may be employed. Instead of a rotary drive, linear pneumatic or hydraulic actuators may also be employed to effect translation movement of the carriage assembly 11 along the linear track 50.

In order to control movement of the carriage assembly 11, the training device 10 preferably includes one or more limit switches 100 and 102 and cooperating trigger members 101 and 103 operative to limit travel of the carriage assembly 11 to left and right outer extremes of the linear track 50. In order to eliminate the need for lengthy electrical wiring, infra-red or radio frequency devices may be employed to provide for wire-less limit switch controls.

Figure 3:
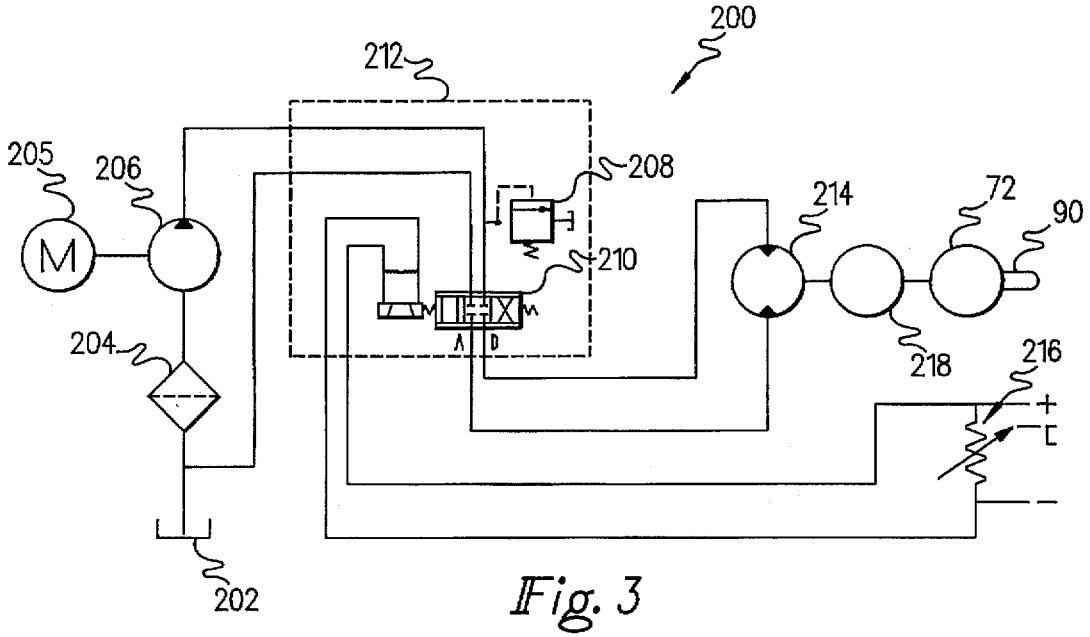
FIG. 3 is a schematic diagram illustrating the hydraulic and electrical carriage drive components of the training device according to an embodiment of the present invention.

FIG. 3 schematically illustrates an example rotaryhydraulic system for driving the drive pulley 72. The hydraulic system includes a fluid reservoir 202, suction strainer 204, an electric motor 205 driving an hydraulic pump 206 and a relief valve 208. A servo valve 210 connected to the system manifold 212 operates to control rotation of a bidirectional rotary hydraulic motor 214, dependent upon control signals received from a potentiometer 216 associated with the sensor 50 shown in FIG. 4. A gear box 218 connects the output shaft of the motor 214 in driving relationship with the drive pulley 72. In its presently preferred form, the invention contemplates the use of a reversible electric motor to directly drive the pulley 72.

Figure 5:
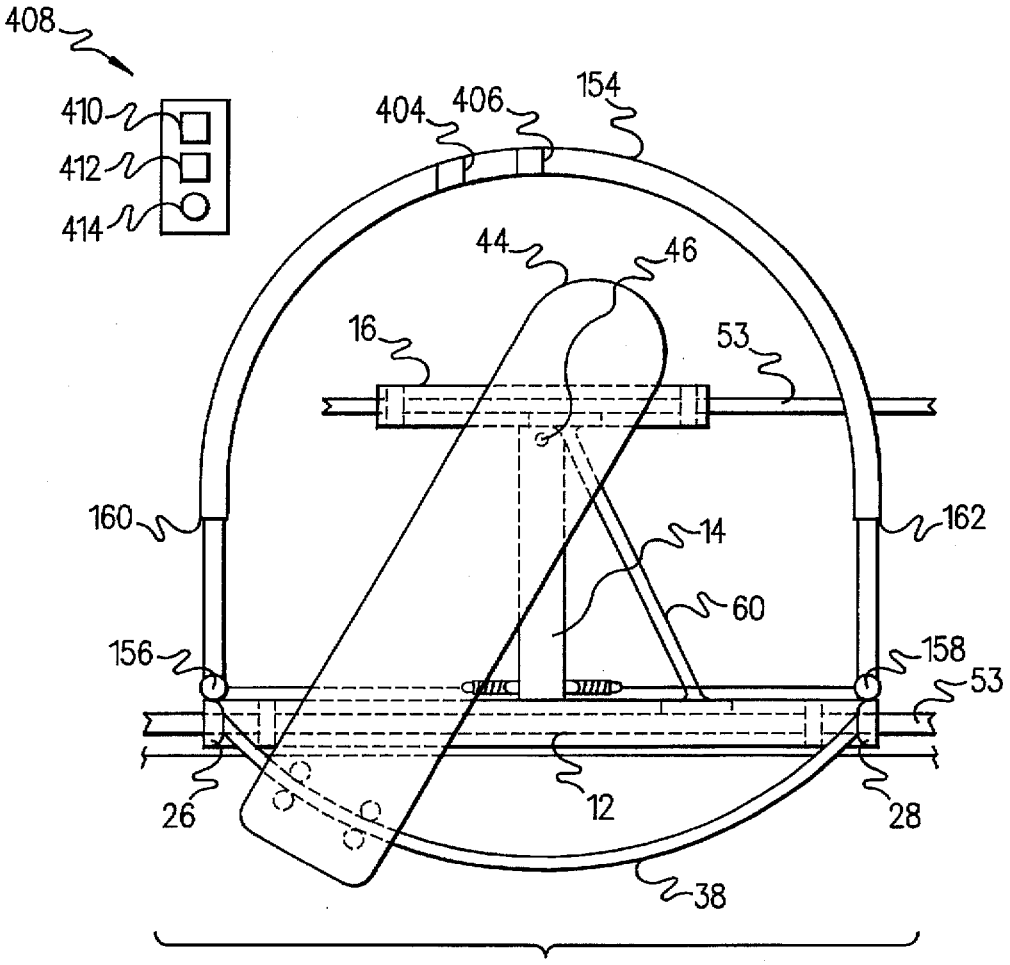
FIG. 5 is a partial top plan view of the training device according to an embodiment of the present invention, illustrating an optional safety hand rail assembly.
Figure 6:
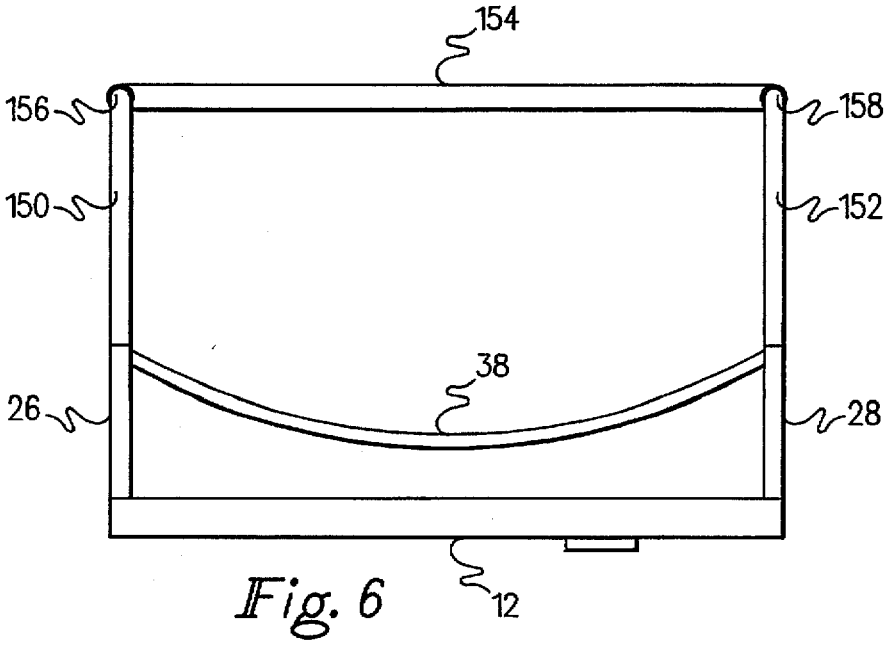
FIG. 6 is a partial rear elevational view of the training device according to an embodiment of the present invention, further illustrating the optional safety hand rail assembly.

In another aspect of the present invention, a detachable hand rail assembly is provided as shown in FIGS. 5 and 6. Left and right vertically extending hand rail standards 150 and 152 include respective arcuate bend portions 156 and 158 connected to an arcuate upper rail portion 154 by respective telescopic connections 160 and 162, thus affording a safety hand rail to a user standing on the support member 154.

Figure 7:
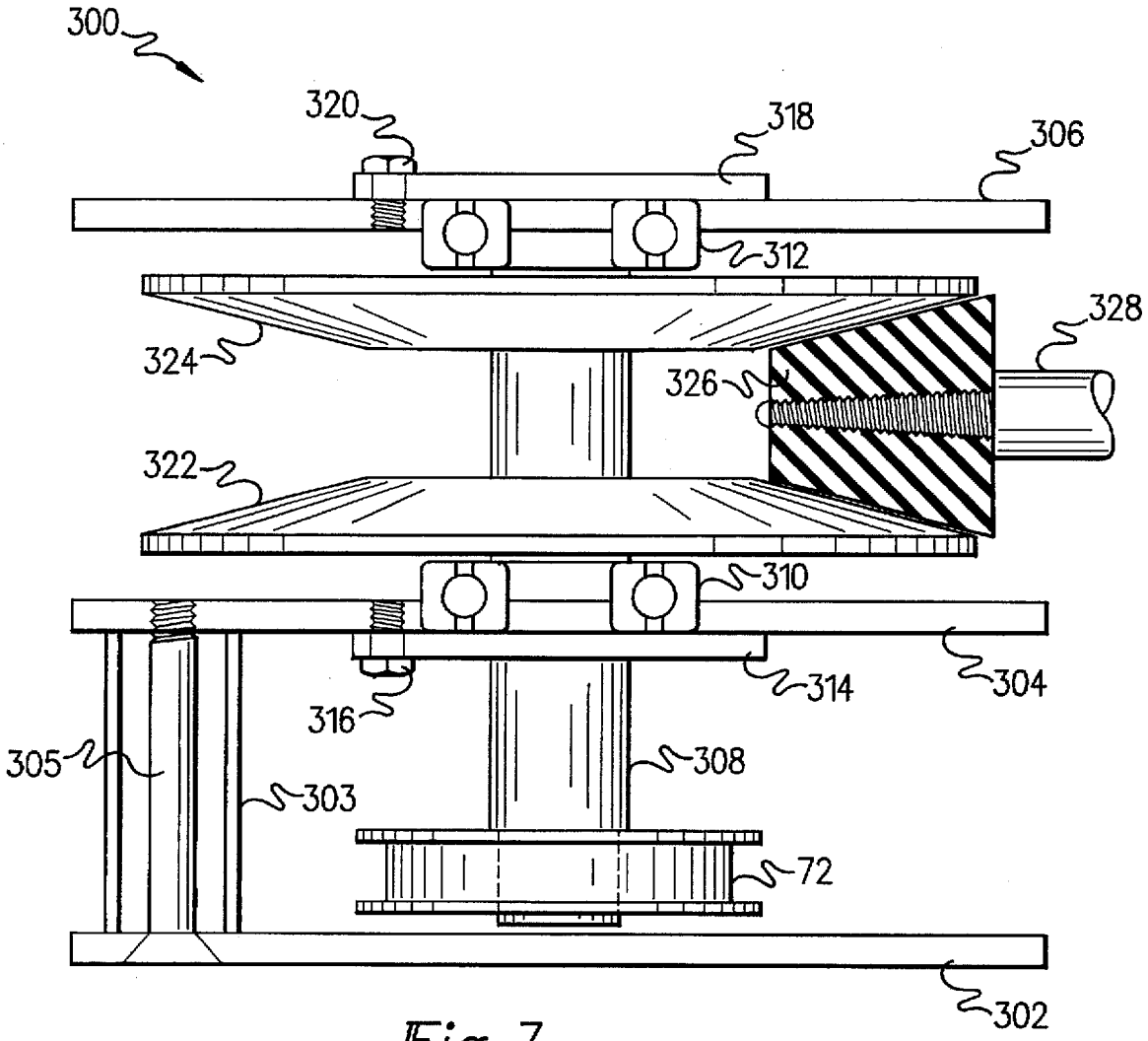
FIG. 7 is a diagrammatic elevational view illustrating a reversible friction drive mechanism according to an embodiment of the present invention, for selectively reciprocating a carriage assembly of the training device in opposite directions along a linear track.
Figure 8:
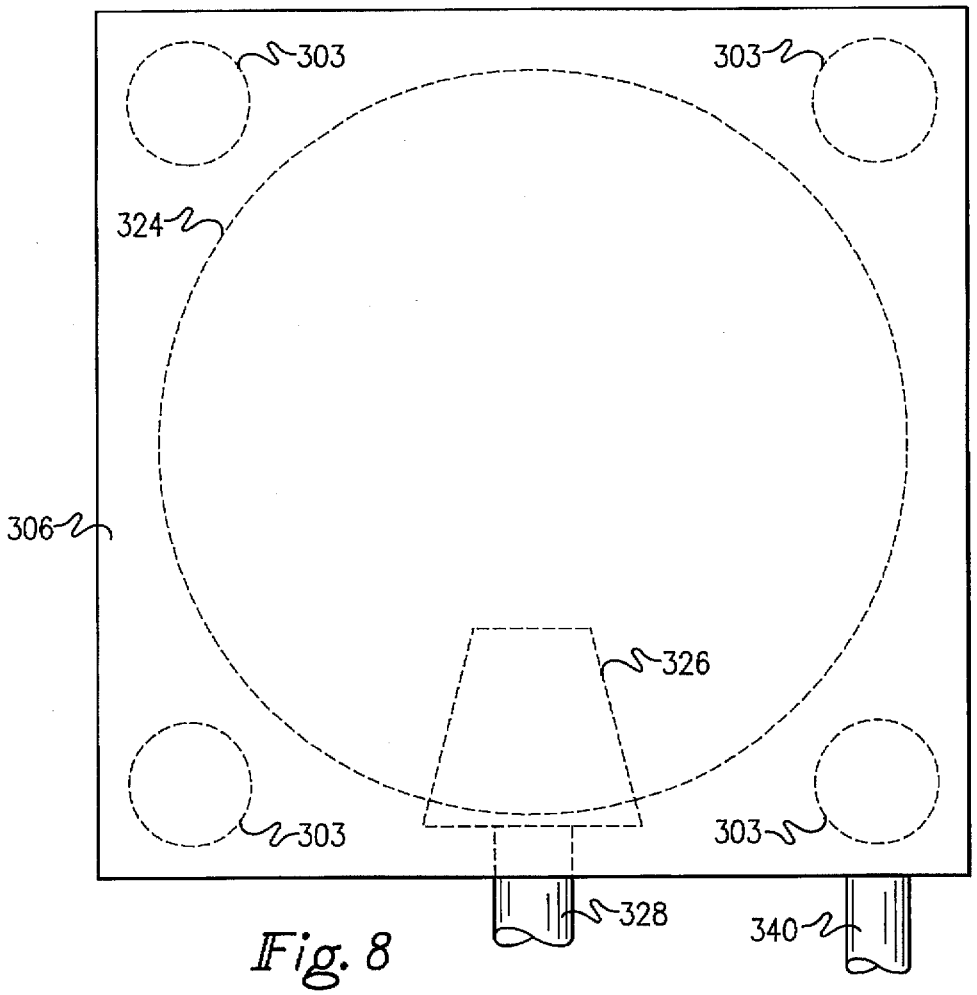
FIG. 8 is a diagrammatic top plan view further illustrating the friction drive mechanism of FIG. 7.
Figure 9:
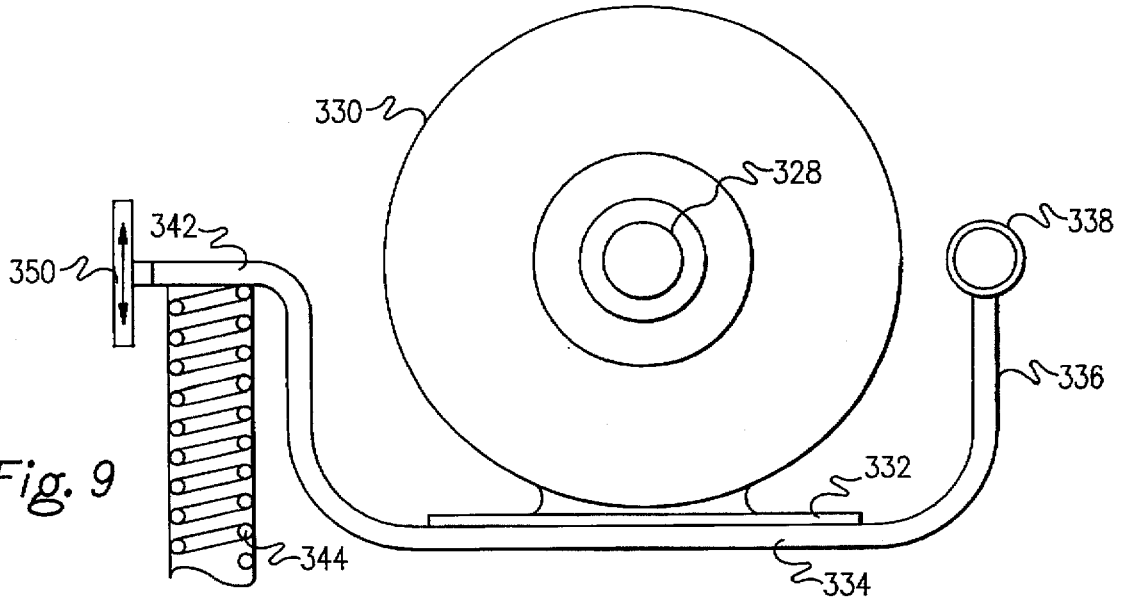
FIG. 9 is an end elevational view further illustrating the friction drive mechanism of FIGS. 7 and 8.

FIGS. 7, 8 and 9 illustrate a friction drive mechanism 300 operative to selectively drive the drive pulley 72 in opposite rotational directions using a variable or constant speed unidirectional electric motor 330. The friction drive mechanism 300 includes a plurality of rectangular spaced support plates 302, 304 and 306 secured in spaced substantially parallel relation by a plurality of spacers and threaded fasteners, one pair of which is illustrated in FIG. 7 at spacer 303 and associated fastener 305. It should be understood that additional fasteners and spacers may be provided to secure the plates 302, 304 and 306 in the illustrated operative relation. The pulley 72 is keyed for rotation with a shaft 308 rotationally mounted by bearings 310 and 312. Respective cap members 314 and 318 secured in position by a plurality of threaded fasteners 316 and 320 mount the bearings 310 and 312 in operative relation to plates 304 and 306. A pair of beveled circular disks 322 and 324, mounted in axially spaced relation on the shaft 308, are shrunk fit or keyed for rotation therewith. The disks 322 and 324 are similar to bevel gears, but have no gear teeth. With reference to FIG. 7, a frustoconical drive member 326 mounted on a rotary output shaft 328 of an electric motor 330 (FIG. 9) is disposed in a center or neutral position between the bevel disks 322 and 324. The drive member 326 and/or the beveled surfaces of the disks 322 and 324 may preferably be formed of a friction enhancing material such as rubber or the like, to facilitate a frictional driving engagement between the drive member 326 and the disks. In the central neutral position illustrated in FIG. 7 the drive member 326 does not engage either of the disks 322 and 324, and thus does not rotationally drive the shaft 308 and attached drive pulley 72. In accordance with the present invention, the drive member 326 is mounted to pivot upwardly or downwardly, into selective engagement with either the upper bevel disk 324 or the lower bevel disk 322. As may be readily understood, with the shaft 328 driving the drive member 326 in a constant rotational direction, engagement of the frictional drive member 326 in driving relation with the upper bevel disk 324 will cause the shaft 308 and pulley 72 to be driven in a first rotational direction, while downward movement of the drive member 326 into engagement with the lower bevel disk 322 will cause the shaft 308 and attached pulley 72 to be driven in an opposite rotational direction.

With reference to FIGS. 8 and 9, an example mechanism operative to provide for the selective pivotal shifting of the frictional drive member 326 into selective engagement with either the upper bevel disk 324 or the lower bevel disk 322 will now be described. As previously mentioned, the frictional drive member 326 is mounted for rotation on an output shaft 328 of a conventional fixed or variable speed unidirectional electric motor 330. A base plate 332 of the motor 330 is secured to a pivotal mounting bracket 334 having a leg portion 336 provided with cylindrical socket 338 which engages a pivot pin 340. A coil compression spring 344 engages a second leg portion 342 of the bracket 334 and biases the mounting bracket 334 to a central neutral position which disposes the frictional drive member 326 in the central neutral position illustrated in FIG. 7, out of contact with the disks 322 and 324. A bidirectional electrical solenoid, diagrammatically illustrated at 350 in FIG. 9, is operative to selectively push the leg 342 of the mounting bracket 334 up or down. In an up position, the frictional drive member 326 is disposed in frictional driving engagement with the upper bevel disk 324. In a lower or down position, the frictional drive member 326 is disposed in frictional driving engagement with a lower bevel disk 322.

In order to provide for user selected or controlled actuation of the frictional drive mechanism 300 in the desired manner, a plurality of switches may be employed. For example, with reference to FIG. 5, an ON/OFF switch 404 disposed on the hand rail 154 allows the user to selectively turn on or off the power to the system. An adjacent LOCAL/REMOTE switch 406 allows a user to select either LOCAL or REMOTE operative modes. In the LOCAL operative mode, a coach or trainer controls reciprocation of the carriage assembly 11 utilizing wired or wireless remote control device 408. The remote control 408 may include a plurality of switches 410, 412 and 414 for selectively driving the carriage 11 in left or right directions, changing the speed of travel, and for stopping movement in its entirety. In a REMOTE mode, control of reciprocal movement of the carriage assembly 11 may be affected by edging of the support member 44 by an individual standing thereon, as illustrated in FIG. 4. For example, a pair of switches 400 and 402 actuated by respective edging in left or right directions may be operative to control actuation of the bidirectional solenoid 350 illustrated in FIG. 9.

While the training device 10 has been illustrated and described with reference to a snow board training device, it may also be employed in connection with training devices for skiing, and other similar sports such as in line skating, skate boarding, surfing, water skiing, wind surfing, bicycling, and the like. Each of these activities entail translation movement initiated by a user leaning or edging in one direction or another, and are thus susceptible to simulation by mounting a suitably configured support member for controlled translational movement along a path dependent upon detection of edging or inclination by a sensor. For example, a bicycle training device in accordance with the present invention may employ a bicycle upon which a user sits mounted for limited inclination and movement upon a translational path. A computer video system may also be employed such that the user attempts to control the bicycle for movement along a bicycle path or road shown on a video or television screen.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed, and reasonable equivalents thereof.

What is claimed is:

1. A training device, comprising:

a guide path including a pair of cylindrical members secured in substantially parallel spaced relation;

a carriage including front and rear rails each provided with a plurality of rollers disposed on said cylindrical members and mounting said carriage for translational movement along said guide path;

an elongated support member adapted for support of a user thereon, said support member including left and right longitudinal edges and mounted on said carriage for limited pivotal movement relative to said carriage such that a user may selectively incline said support member to lower either said left or right edge;

said carriage including an arcuate track;

means for supporting said support member for movement along said arcuate track;

a sensor operably connected to said support member for detecting inclination of said support member relative to said carriage; and a drive system operably connected to said carriage and to said sensor for moving said carriage along said guide path in response to said limited movement of said support member relative to said carriage.

2. The training device of claim 1, wherein said drive system includes:

a cable and pulley system.

3. The training device of claim 1 wherein said drive system includes:

a reversible electric motor.

4. The training device of claim 1 wherein said drive system includes:

a hydraulic motor.

5. The training device of claim 1 wherein said sensor includes:

a potentiometer.

6. The training device of claim 1 wherein said sensor includes:

at least one limit switch.

7. The training device of claim 1 wherein said sensor includes:

at least one limit switch to limit the translational movement of said carriage.

8. The training device of claim 1 wherein said support member is configured as a snow board.

9. The training device of claim 1, further comprising an elastomeric material disposed for controlling inclination of said support member.

10. A training device, comprising:

a carriage assembly mounted for movement along a guide path;

a support member for supporting a user, said support member including left and right longitudinal edges and mounted on said carriage assembly for limited pivotal movement relative to said carriage assembly such that a user may selectively incline said support member to lower either said left or right edge;

said carriage assembly including an arcuate track;

means for supporting said support member for movement along said arcuate track;

sensing means operably connected to said support member for detecting inclination of said support member relative to said carriage assembly; and a drive system operably connected to said carriage assembly and to said sensing means for moving said carriage assembly along said guide path in response to said limited movement of said support member relative to said carriage assembly.

11. The training device of claim 10 wherein said guide path includes:

a pair of elongated members secured in substantially parallel spaced relation.

12. The training device of claim 10 wherein said carriage assembly includes:

a front rail;

a first set of rollers on said front rail for engagement with said guide path;

a rear rail; and a second set of rollers on said rear rail for engagement with said guide path.

13. The training device of claim 10 wherein said carriage assembly includes:

a front rail;

means on said support member for mounting on said front rail for limited pivotal movement of said support member relative to said front rail;

a first set of rollers on said front rail for engagement with said guide path;

a rear rail;

a second set of rollers on said rear rail for engagement with said guide path;

an arcuate track mounted on said rear rail; and means for supporting said support member for movement along said arcuate track.

14. A training device, comprising:

a carriage assembly mounted for movement along a guide path;

said carriage assembly including an arcuate track;

a support member for supporting a user, said support member including left and right longitudinal edges and mounted on said carriage assembly for limited pivotal movement relative to said carriage assembly such that a user may selectively incline said support member to lower either said left or right edge;

means for supporting said support member for movement along said arcuate track;

sensing means operably connected to said support member for detecting inclination of said support member relative to said carriage assembly; and a drive system operably connected to said carriage assembly and to said sensing means for moving said carriage assembly along said guide path in response to said limited movement of said support member relative to said carriage assembly.

15. A training device, comprising:

a carriage assembly mounted for movement along a guide path;

a front rail;

a first set of rollers on said front rail for engagement with said guide path;

a rear rail;

a second set of rollers on said rear rail for engagement said guide path;

an arcuate track mounted on said rear rail;

a support member for supporting a user, said support member including left and right longitudinal edges and mounted on said carriage assembly for limited pivotal movement relative to said carriage assembly such that a user may selectively incline said support member to lower either said left or right edge;

means on said support member for mounting on said front rail for limited pivotal movement of said support member relative to said front rail;

means for supporting said support member for movement along said arcuate track;

sensing means operably connected to said support member for detecting inclination of said support member relative to said carriage assembly; and a drive system operably connected to said carriage assembly and to said sensing means for moving said carriage assembly along said guide path in response to said limited movement of said support member relative to said carriage assembly.

* * * * *